US006715635B1

(12) United States Patent
Arndt

(10) Patent No.: US 6,715,635 B1
(45) Date of Patent: Apr. 6, 2004

(54) BILL SECURING STRAP HOLDING AND DISPENSING SYSTEM

(76) Inventor: Douglas D. Arndt, 2 Dart Dr., Watertown, SD (US) 57201

( * ) Notice: Subject to any disclaimer, the term of this patent is extended or adjusted under 35 U.S.C. 154(b) by 0 days.

(21) Appl. No.: 10/158,958

(22) Filed: May 31, 2002

(51) Int. Cl.[7] ..... B65H 1/00

(52) U.S. Cl. ..... 221/45; 221/33; 221/63; 221/34; 206/39; 206/555

(58) Field of Search ..... 221/33, 45, 46, 221/61, 63, 34; 206/497, 39, 39.7, 555, 817, 815

(56) References Cited

U.S. PATENT DOCUMENTS 3,051,584 A * 8/1962 Tindall ..... 426/115
RE27,297 E * 2/1972 Johnson et al. ..... 221/308
4,275,814 A * 6/1981 Kageyama et al. ..... 206/455
4,358,012 A * 11/1982 Marsala et al. ..... 206/39
4,585,145 A * 4/1986 Pitroda ..... 221/58
2002/0179624 A1 * 12/2002 Tramontina ..... 221/33

* cited by examiner

*Primary Examiner*—Donald P. Walsh
*Assistant Examiner*—Matthew J. Kohner
(74) *Attorney, Agent, or Firm*—Leonard & Proehl, P.L.L.C.

(57) ABSTRACT

A bill securing strap holding and dispensing system for holding a plurality of bill securing straps in an easily grasped fashion to permit dispensing of one securing strap at a time includes a holder having a pair of spaced walls and a plurality of fibers extending from the spaced walls to grip the stack of bill securing straps. Multiple embodiments are disclosed to accommodate both single stacks of bill securing straps and multiple stacks for different denominations of bills.

23 Claims, 6 Drawing Sheets

BILL SECURING STRAP HOLDING AND DISPENSING SYSTEM

BACKGROUND OF THE INVENTION

1. Field of the Invention

The present invention relates to bill securing strap holders and more particularly pertains to a new bill securing strap holding and dispensing system for holding a plurality of bill securing straps in an easily grasped fashion to permit dispensing of one securing strap at a time.

2. Description of the Prior Art

The use of bill securing strap holders is known in the prior art. Typically, bill securing strap holders consist of slotted or compartmented racks that loosely receive a stack of bill securing straps. While these racks serve to separate different denominations of bill securing straps, the adhesive commonly found on the straps prevents the easy grasping and removal of a single strap from the slot or compartment. The straps cling together due to the adhesive and must often be separated using two hands and the excess straps replaced in the slot or compartment. Another typical feature of currently used bill securing strap racks is that several compartments or slots are incorporated into a single structure thus resulting in a rather bulky piece of equipment that is not easily portable should a person need or want to use the bill securing straps in a location remote to their typical work station.

While these devices fulfill their respective, particular objectives and requirements, the need remains for a device that not only organizes bill securing straps of different denominations but holds each stack of straps firmly enough to permit grasping and removal of a single strap using one hand. Further, the need remains for a compact device to hold individual stacks of bill securing straps to permit easy transport of individual stacks of straps when needed.

SUMMARY OF THE INVENTION

The present invention meets the needs presented above by providing a holder having a pair of spaced walls and a plurality of fibers extending from the spaced walls to grip the stack of bill securing straps.

An object of the present invention is to provide a new bill securing strap holding and dispensing system that holds individual stacks of bill securing straps to permit customizable organization and easy reorganization for multiple bill stacks of bill securing straps.

Another object of the present invention is to provide a new bill securing strap holding and dispensing system that permits selective placement of multiple bill securing strap holders in a drawer to fit into available space adjacent to or around other items in the drawer.

To this end, the present invention generally comprises a main member having a bottom portion and a pair of spaced walls extending up from the bottom portion. A plurality of fibers line the upper face of the bottom portion and the inwardly directed faces of the spaced walls to retain a stack of bill securing straps between the spaced walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
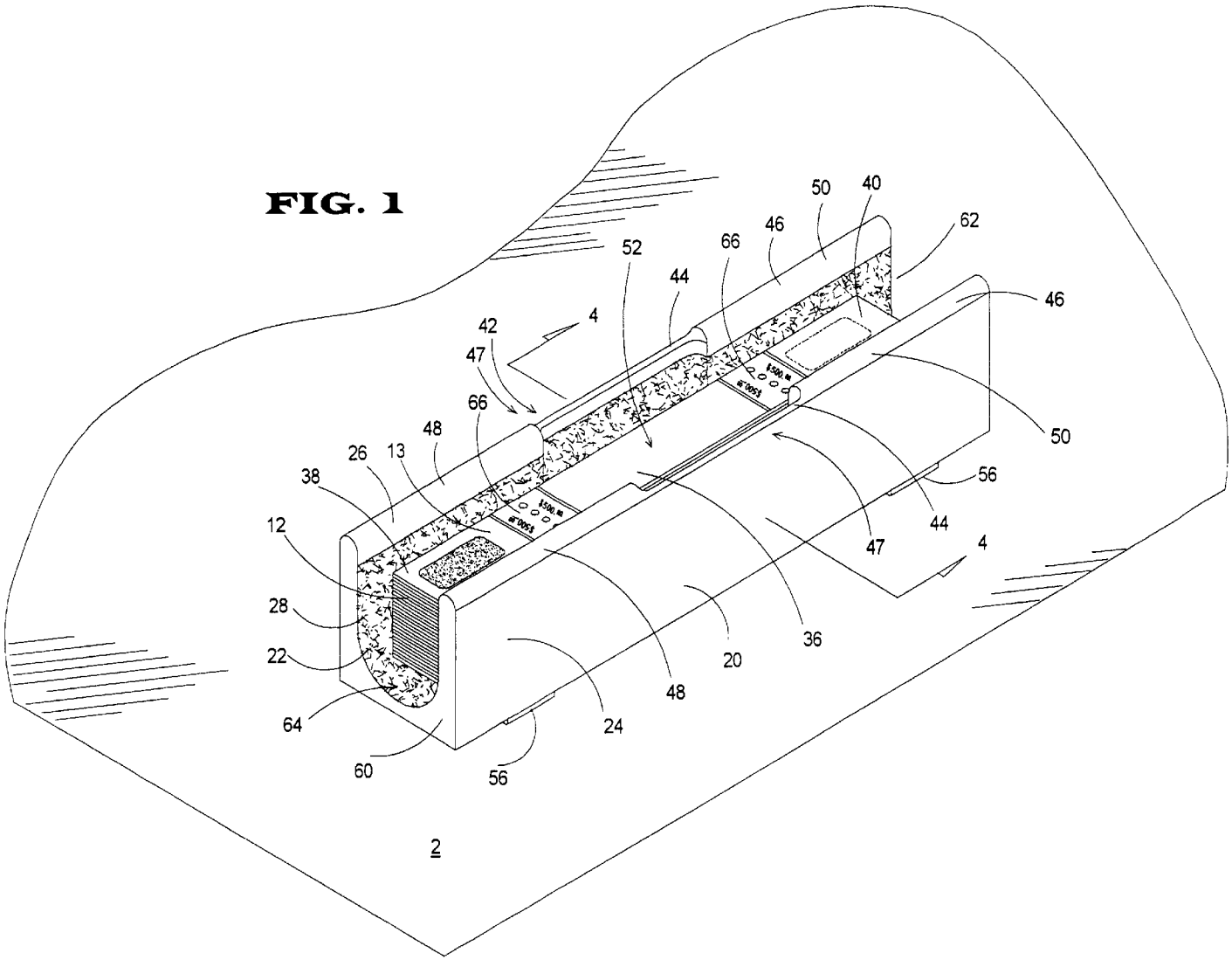
FIG. 1 is a perspective view of a new bill securing strap holding and dispensing system according to the present invention.
Figure 2:
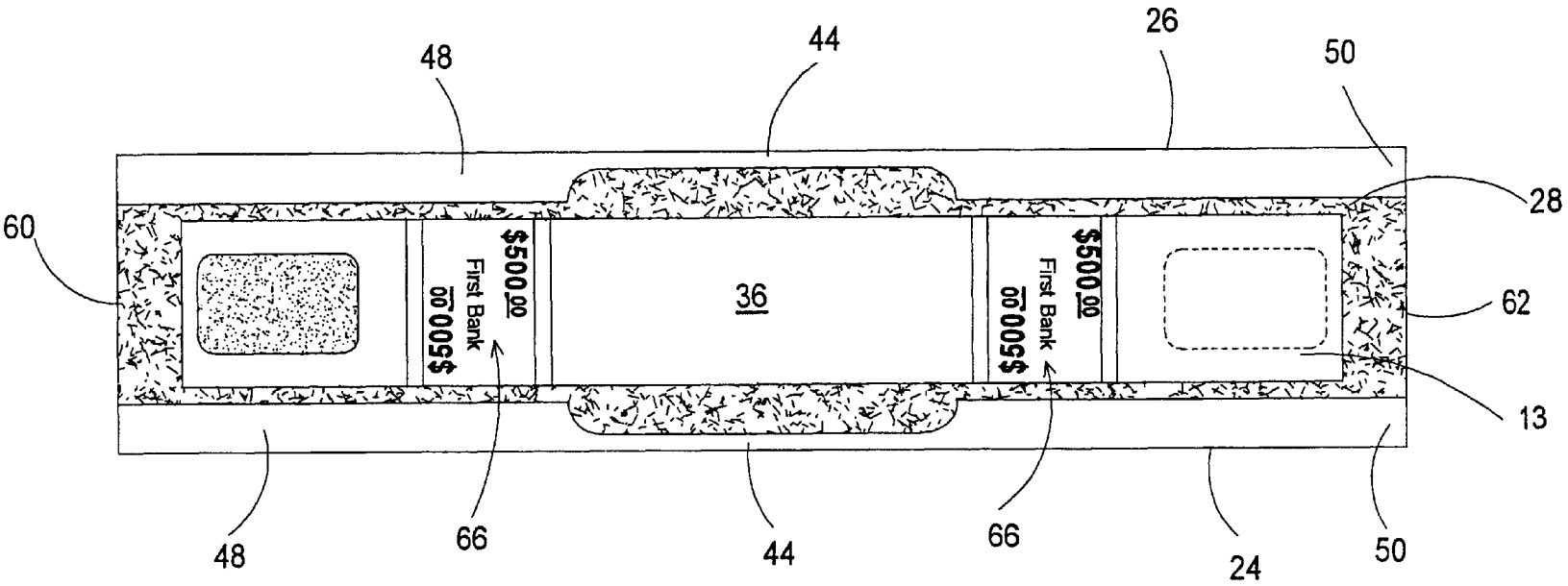
FIG. 2 is a top view of the present invention.
Figure 3:
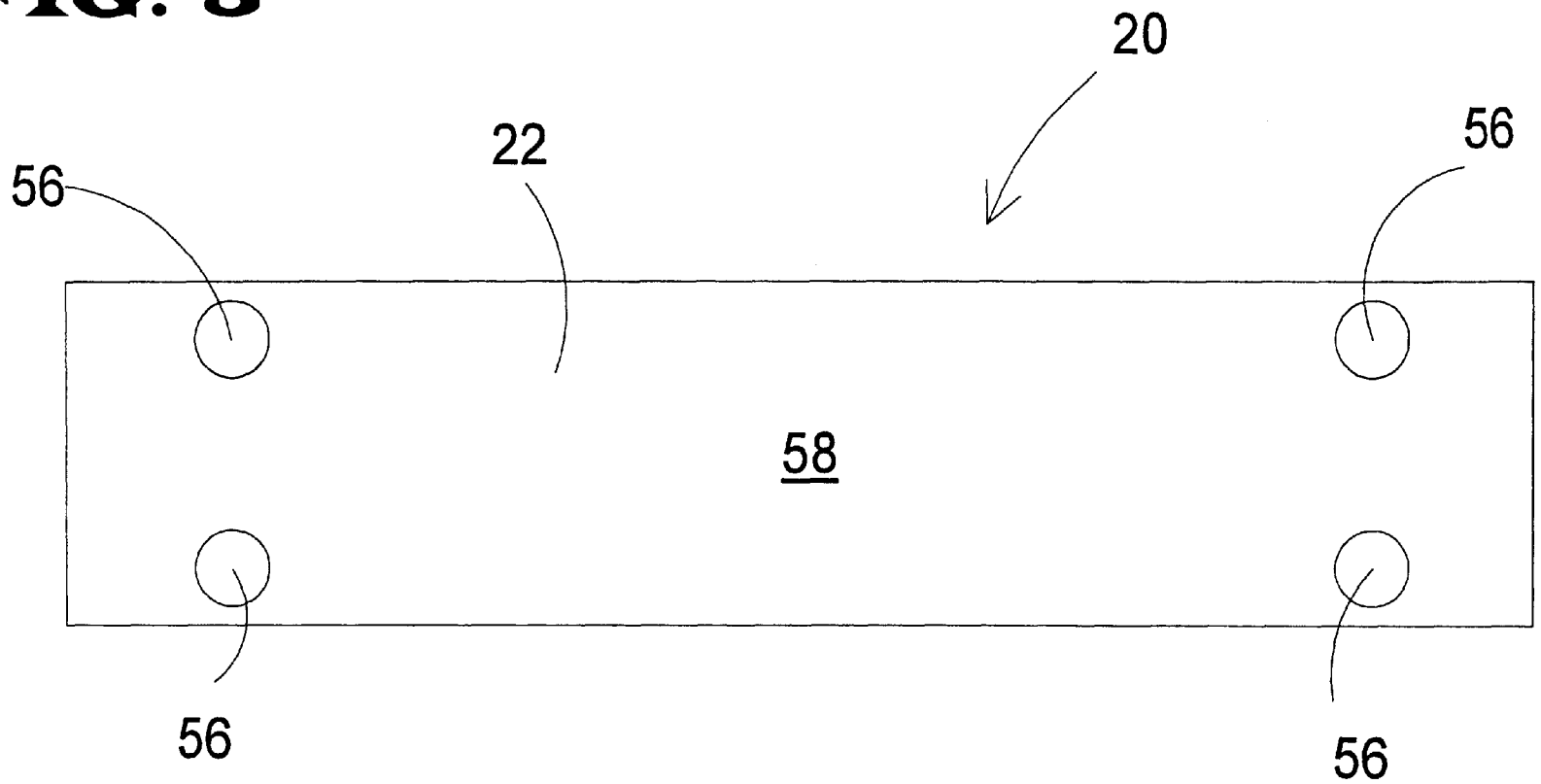
FIG. 3 is a bottom view of the present invention.
Figure 4:
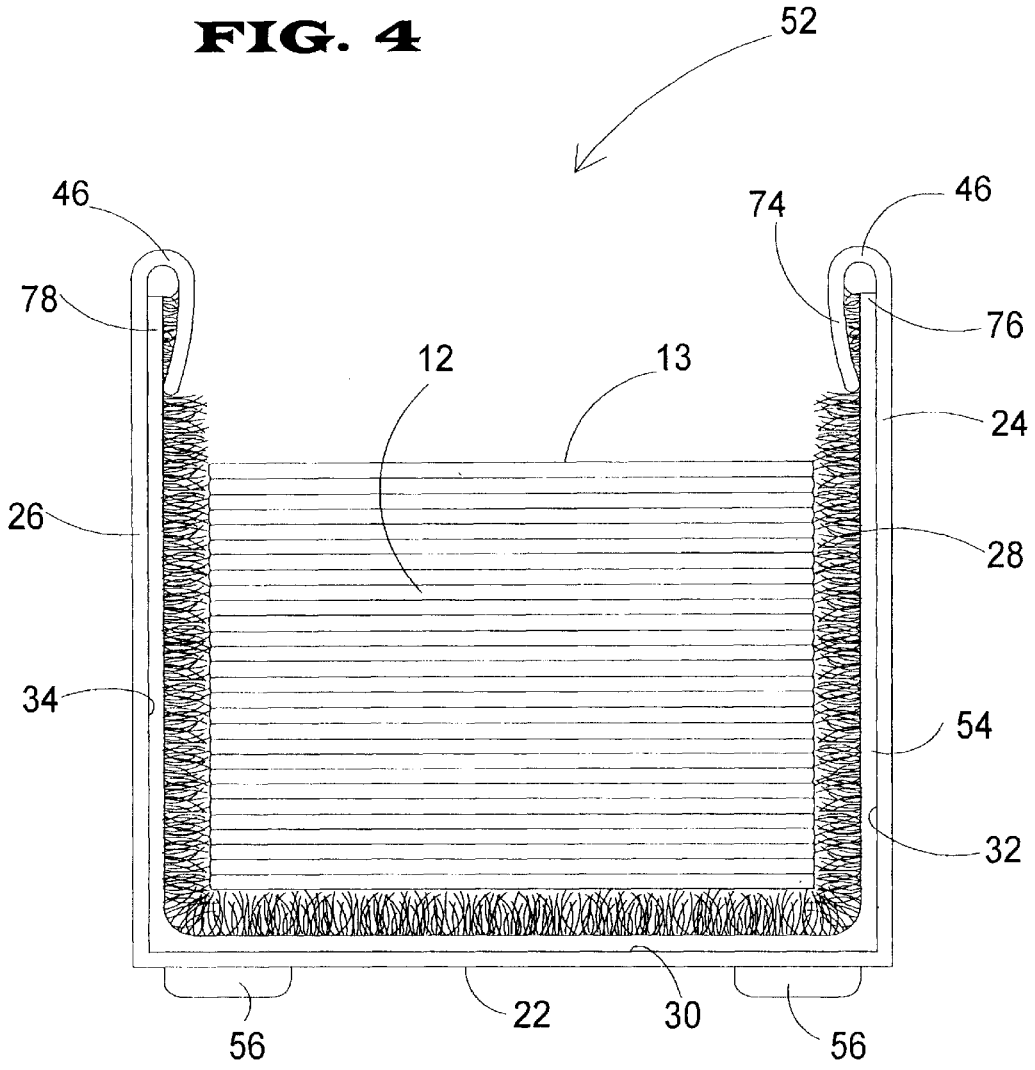
FIG. 4 is a cross-sectional view of the present invention taken along line 4—4 of FIG. 1.
Figure 5:
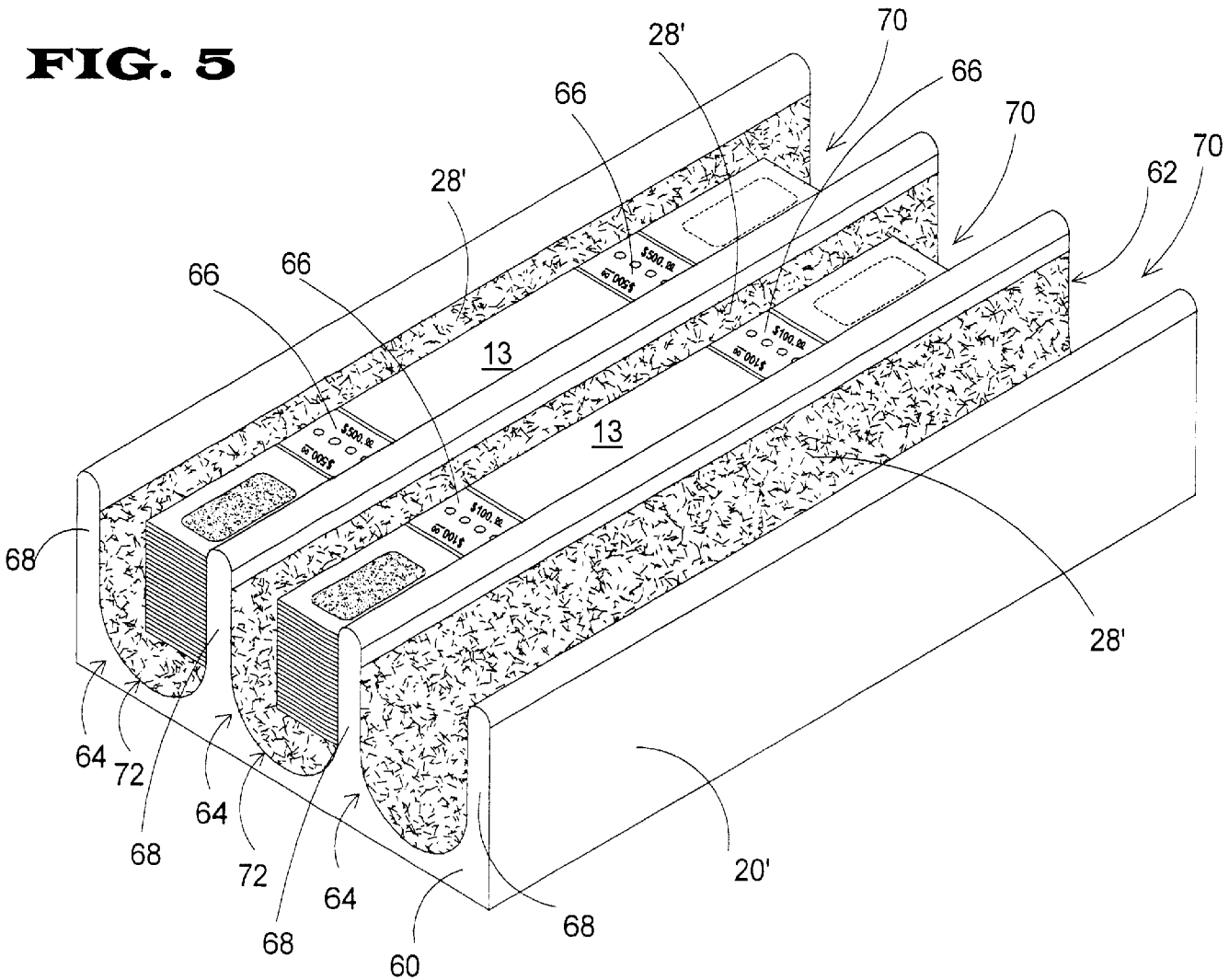
FIG. 5 is a perspective view of an alternate embodiment of the present invention.
Figure 6:
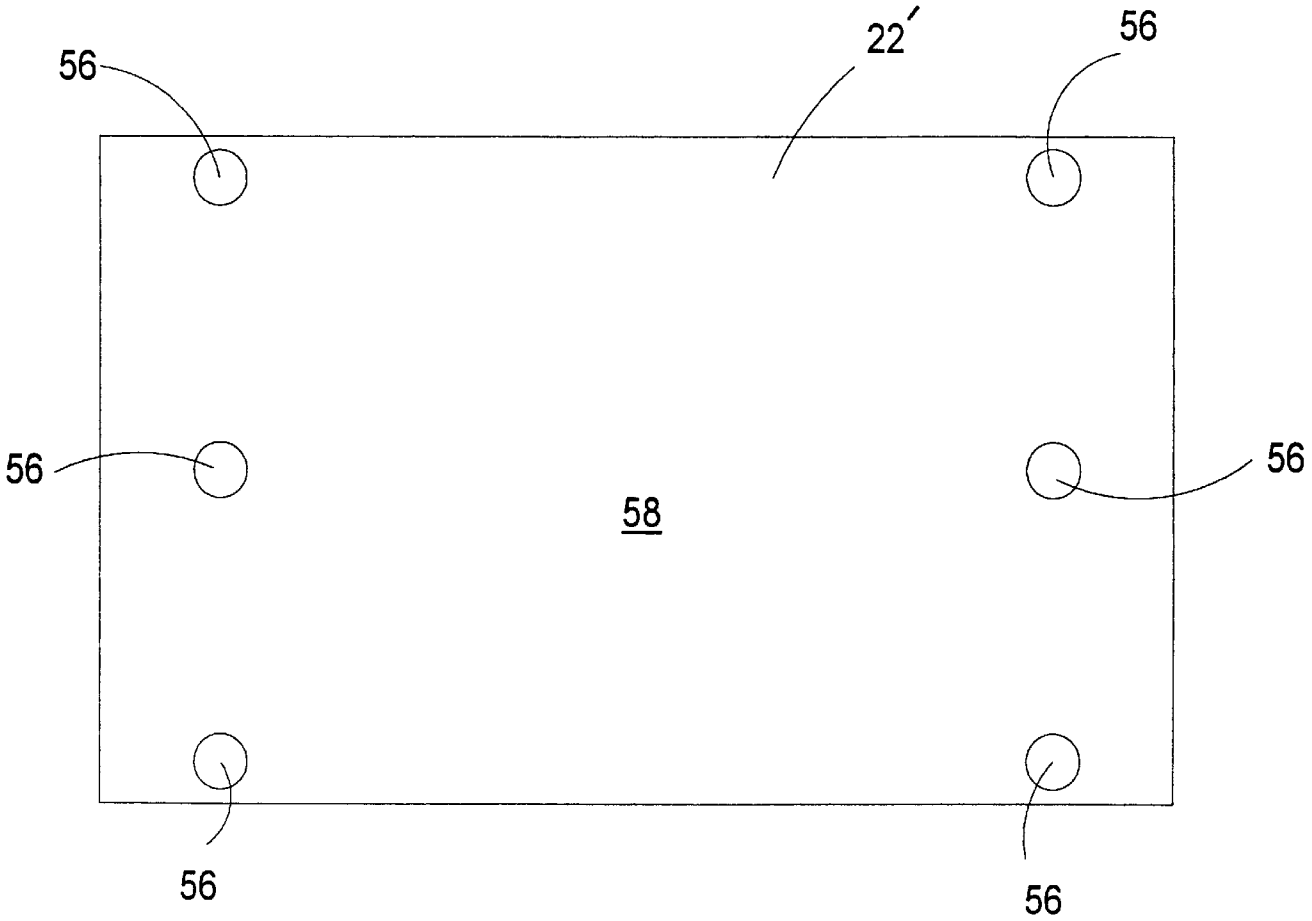
FIG. 6 is a bottom view of an alternate embodiment of the present invention.

With reference now to the drawings, and in particular to FIGS. 1 through 6 thereof, a new bill securing strap holding and dispensing system embodying the principles and concepts of the present invention and generally designated by the reference numeral will be described.

As best illustrated in FIGS. 1 through 6, the bill securing strap holding and dispensing system 10 generally comprises a plurality of bill securing straps 12, a main member 20 that has a bottom portion 22 and a pair of spaced walls 24, 26 extending up from the bottom portion 22. A plurality of fibers 28 line an upper face 30 of the bottom portion 22 and inwardly directed faces 32, 34 of the spaced walls 24, 26 to retain the plurality of bill securing straps 12 in a stack between the spaced walls 24, 26 such that an uppermost one of the bill securing straps 13 is removable from the main member 20.

The main member 20 has a length greater than a length of the bill securing straps 12 such that the bill securing straps 12 are positionable between the spaced walls 24, 26 such that the lining fibers 28 engage the full length of the bill securing straps 12.

A medial portion 36 of the uppermost one of the bill securing straps 13 is positioned between the spaced walls 24, 26 such that the medial portion 36 is designed for being frictionally engaged by a pair of spaced fingers to permit pinching the medial portion 36 such that opposite ends 38, 40 of the uppermost bill securing strap 13 are drawn inwardly towards a medial portion 42 of the main member 20 to facilitate lifting of the uppermost bill securing strap 13 up and out of the main member 20. Typically, each bill securing strap has adhesive attached on opposite faces and at opposite ends thus holding the bill securing straps in a stack and facilitating securing individual bill securing straps around a stack of bills. The plurality of fibers 28 assists in holding the stack of bill securing straps 12 securely enough to permit disengaging of the adhesive between the uppermost bill securing strap 13 and an adjacently positioned one of the bill securing straps 12 when medial portion 36 of the uppermost bill securing strap 13 is pinched.

In an embodiment, a medial portion 44 of an upper portion 46 of each of the spaced walls 24, 26 has a thickness less than outer portions 48, 50 of the upper portions 46 of the spaced walls 24, 26 on opposite sides of the medial portion 44 for facilitating removal of the uppermost one of the bill securing straps 13 through a gap 52 between the medial portions 44 of the upper portions 46 of the spaced walls 24, 26.

A backing member 54 is coupled to the main member 20 and the plurality of fibers 28 extend from the backing member 54. Typically, industrial carpeting such as that found in automotive interiors or loop fastener can be used effectively when the spacing between the walls is sufficiently close to permit engagement of the fibers with the sides of the bill securing straps.

Feet members 56 are coupled to a bottom surface 58 of the bottom portion 22 of the main member 20. Preferably, each of the feet members 56 is a felt pad whereby the feet members 56 are designed for preventing scuffing of a surface 2 on which the main member 20 is supported by the feet members 56. Alternately, rubber or other known scuff-resistant materials may be used in place of felt.

A pair of end walls 60, 62 are provided. Each of the end walls 60, 62 is coupled to an associated end of the main member 20. Each of the end walls 60, 62 has a cutout portion 64 such that each end wall 60, 62 is substantially U-shaped to facilitate visual inspection of a remaining number of bill securing straps in said main member 20.

In an embodiment, the upper portion 46 of each of the spaced walls 24, 26 is folded over to form a lip 74. Opposite edges 76, 78 of the backing member 54 are received between an associated one of the lips 74 and an associated one of the spaced walls 24, 26 whereby the plurality of fibers 28 are retained between the spaced walls 24, 26. A medial portion 47 of each lip 74 curves inwardly to secure the backing member 54 between the medial portion 47 of the lip 74 and the associated spaced wall 24, 26.

In an alternate embodiment for storing multiple stacks of bill retaining straps in a single device, a plurality of bill securing straps 12 are provided wherein each bill securing strap has indicia 66 associated with a distinct bill amount. The bill securing straps 12 are arranged into groups of straps having similar indicia. The main member 20' has a bottom portion 22' and a plurality of spaced walls 68 forming a plurality of channels 70. Similarly, a plurality of fibers 28' line each of the channels 70 to retain each group of straps having similar indicia in a respective one of the channels 70 such that an uppermost one of the bill securing straps 13' of each group of straps having similar indicia is removable from the main member 20 in the same manner described above. Each channel 70 operates substantially equivalent to the single space between the spaced walls 24, 26.

To accommodate multiple channels 70, each of the end walls 60', 62' has a plurality of cutout portions 64' such that each end wall forms a plurality of U-shaped portions 72. Each of the U-shaped portions 72 is aligned with an associated one of the channels 70.

In use, a stack of bill retaining straps is placed into the channel formed between adjacently positioned spaced walls. The walls are spaced such that fibers engage the stack of bill securing straps. A user places two fingers on the uppermost bill securing strap and a pinching motion draws the middle of the uppermost bill securing strap up into a graspable position to permit pulling of the grasped strap from the device. Thus, an individual one of the bill securing straps is easily and quickly releasable from the stack of straps.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bill securing strap holding and dispensing system comprising:

a plurality of bill securing straps;

a main member having a bottom portion and a pair of spaced walls extending up from the bottom portion;

a plurality of fibers lining an upper face of said bottom portion and inwardly directed faces of said spaced walls to retain said plurality of bill securing straps in a stack between said spaced walls such that an uppermost one of said bill securing straps is removable from said main member.

2. The bill securing strap holding and dispensing system of claim 1, further comprising:

said main member having a length greater than a length of said bill securing straps such that said bill securing straps are positionable such that a full length of each of said plurality of bill securing straps is positioned between said spaced walls.

3. The bill securing strap holding and dispensing system of claim 1, further comprising:

a medial portion of an upper portion of each of said spaced walls having a thickness less than outer portions of said upper portions of said spaced walls on opposite sides of said medial portion of said upper portion for facilitating removal of said uppermost one of said bill securing straps through a gap between said medial portions of said upper portions of said spaced walls.

4. The bill securing strap holding and dispensing system of claim 1, further comprising:

a backing member coupled to said main member, said plurality of fibers extending from said backing member.

5. The bill securing strap holding and dispensing system of claim 1, further comprising:

a plurality of feet members coupled to a bottom surface of said bottom portion of said main member.

6. The bill securing strap holding and dispensing system of claim 5 wherein each of said plurality of feet members is a felt pad whereby said feet members are adapted for preventing scuffing of a surface on which said main member is supported by said feet members.

7. The bill securing strap holding and dispensing system of claim 2 further comprising:

a pair of end walls, each of said end walls being coupled to an associated end of said main member.

8. The bill securing strap holding and dispensing system of claim 7 wherein each of said end walls has a cutout portion such that each end wall is substantially U-shaped.

9. The bill securing strap holding and dispensing system of claim 1 wherein an upper portion of each of said spaced walls is folded over to form a lip.

10. The bill securing strap holding and dispensing system of claim 9, further comprising:

a backing member, said plurality of fibers extending from said backing member, opposite edges of said backing member being received between an associated one of said lips and an associated one of said spaced walls whereby said plurality of fibers are retained between said spaced walls.

11. The bill securing strap holding and dispensing system of claim 10, further comprising:

a medial portion of each lip curving inwardly to secure said backing member between said medial portion of said lip and said spaced wall.

12. The bill securing strap holding and dispensing system of claim 1 wherein said main member has opposite ends, and wherein the main member has an open top extending from a first one and a second one of said pair of spaced walls and extending from a first one of said opposite ends to a second one of said opposite ends.

13. The bill securing strap holding and dispensing system of claim 1 wherein said main member has opposite ends, each of said opposite ends being substantially open between said pair of spaced walls.

14. The bill securing strap holding and dispensing system of claim 1 wherein said main member has opposite ends, said spaced walls being oriented substantially perpendicular to said bottom portion, each of said spaced walls having an upper edge, said upper edges of said spaced walls forming an upper opening extending from a first one of said pair of spaced walls to a second one of said pair of spaced walls, said opening extending from a first one of said opposite ends to a second one of said opposite ends.

15. The bill securing strap holding and dispensing system of claim 1, wherein said main member has a length greater than a length of said bill securing straps such that said bill securing straps are positionable such that a full length of each of said plurality of bill securing straps is positioned between said spaced walls;

a medcial portion of an upper portion of each of said spaced walls having a thickness less than outer portions of said upper portions of said spaced walls on opposite sides of said medial portion of said upper portion for facilitating removal of said uppermost one of said bill securing straps through a gap between said medial portions of said upper portions of said spaced walls;

a backing member being coupled to said main member, said plurality of fibers extending from said backing member;

a plurality of feet members being coupled to a bottom surface of said bottom portion of said main member;

wherein each of said plurality of feet members is a felt pad whereby said feet members are adapted for preventing scuffing of a surface on which said main member is supported by said feet members;

a pair of end walls, each of said end walls being coupled to an associated end of said main member;

wherein each of said end walls has a cutout portion such that each end wall is substantially U-shaped; and wherein said main member has opposite ends, and wherein the main member has an open top extending from a first one and a second one of said pair of spaced walls and extending from a first one of said opposite ends to a second one of said opposite ends.

16. A bill securing strap holding and dispensing system comprising:

a plurality of bill securing straps, each bill securing strap having indicia associated with a distinct bill amount, said bill securing straps being arranged into groups of straps having similar indicia;

a main member having a bottom portion and a plurality of spaced walls forming a plurality of channels; and a plurality of fibers lining each of said channels to retain each group of straps having similar indicia in a respective one of said channels such that an uppermost one of said bill securing straps of each group of straps having similar indicia is removable from said main members;

wherein said plurality of fibers line an upper face of said bottom portion of said main member.

17. The bill securing strap holding and dispensing system of claim 16, further comprising:

each of said channels of said main member having a length greater than a length of said group of straps having similar indicia such that each said group of straps having similar indicia are positionable such that a full length of each bill securing strap of each group of straps having similar indicia is positioned between said spaced walls in said respective one of said channels.

18. The bill securing strap holding and dispensing system of claim 16, further comprising:

a backing member coupled to said main member, said plurality of fibers extending from said backing member.

19. The bill securing strap holding and dispensing system of claim 16, further comprising:

a plurality of feet members coupled to a bottom surface of said bottom portion of said main member.

20. The bill securing strap holding and dispensing system of claim 19 wherein each of said plurality of feet members is a felt pad whereby said feet members are adapted for preventing scuffing of a surface on which said main member is supported by said feet members.

21. The bill securing strap holding and dispensing system of claim 17 further comprising:

a pair of end walls, each of said end walls being coupled to an associated end of said main member.

22. The bill securing strap holding and dispensing system of claim 21 wherein each of said end walls has a plurality of cutout portions such that each end wall forms a plurality of U-shaped portions, each of said U-shaped portions being aligned with an associated one of said channels.

23. The bill securing strap holding and dispensing system of claim 16, wherein each of said channels of said main member having a length greater than a length of said group of straps having similar indicia such that each said group of straps having similar indicia are positionable such that a full length of each bill securing strap of each group of straps having similar indicia is positioned between said spaced walls in said respective one of said channels;

a backing member being coupled to said main member, said plurality of fibers extending from said backing member;

a plurality of feet members being coupled to a bottom surface of said bottom portion of said main member;

wherein each of said plurality of feet members is a felt pad whereby said feet members are adapted for preventing scuffing of a surface on which said main member is supported by said feet members;

a pair of end walls, each of said end walls being coupled to an associated end of said main member;

wherein each of said end walls has a plurality of cutout portions such that each end wall forms a plurality of U-shaped portions, each of said U-shaped portions being aligned with an associated one of said channels;

wherein an upper portion of each of said spaced walls is folded over to form a lip;

a backing member, said plurality of fibers extending from said backing member, opposite edges of said backing member being received between an associated one of said lips and an associated one of said spaced walls whereby said plurality of fibers are retained between said spaced walls; and a medial portion of each lip curving inwardly to secure said backing member between said medial portion of said lip and said spaced wall.

* * * * *